US006892688B2

(12) United States Patent
Korenjak et al.

(10) Patent No.: US 6,892,688 B2
(45) Date of Patent: May 17, 2005

(54) AUTOMATIC MECHANICAL DECOMPRESSOR FOR AN INTERNAL COMBUSTION ENGINE

(75) Inventors: Norbert Korenjak, Stadl-Paura (AT); Johann Holzleitner, Gunskirchen (AT)

(73) Assignee: BRP-Rotax GmbH & Co. KG, Gunskirchen (AT)

( * ) Notice: Subject to any disclaimer, the term of this patent is extended or adjusted under 35 U.S.C. 154(b) by 0 days.

(21) Appl. No.: 10/668,366

(22) Filed: Sep. 24, 2003

(65) Prior Publication Data

US 2004/0134455 A1 Jul. 15, 2004

Related U.S. Application Data

(60) Provisional application No. 60/412,803, filed on Sep. 24, 2002.

(51) Int. Cl.[7] ..... F02D 15/00; F02N 17/08

(52) U.S. Cl. ..... 123/182.1

(58) Field of Search ..... 123/182.1; 417/299; 137/505.28

(56) References Cited

U.S. PATENT DOCUMENTS 2,742,380 A * 4/1956 Peters ..... 123/182.1
3,782,354 A * 1/1974 Tuckey ..... 123/182.1
3,893,440 A * 7/1975 Dooley ..... 123/182.1
4,619,228 A 10/1986 Liu

FOREIGN PATENT DOCUMENTS

| | | |
|---|---|---|
| DE | 194541 | 9/1977 |
| DE | 4000864 | 7/1991 |
| JP | 61038162 | 2/1986 |
| SE | 9702631 | 1/1999 |

* cited by examiner

*Primary Examiner*—Andrew M. Dolinar
(74) *Attorney, Agent, or Firm*—BRP Legal Services

(57) ABSTRACT

A decompressor for use in an internal combustion engine is disclosed The decompressor is at least partially located within the venting passageway in response to pressure in the combustion chamber for selectively opening the venting passageway such that combustion gas located within the chamber is vented to the induction passageway. The decompressor opens the venting passageway when the engine is off and during an engine start up operation. The decompressor includes an expansible cavity operatively connected to the combustion chamber.

28 Claims, 5 Drawing Sheets

AUTOMATIC MECHANICAL DECOMPRESSOR FOR AN INTERNAL COMBUSTION ENGINE

CROSS REFERENCE TO RELATED APPLICATION

This application relates to and claims priority to U.S. Provisional Application No. 60/412,803, entitled "Decompressor for a Two-Cycle Engine," filed on Sep. 24, 2002, the disclosure of which is specifically incorporated herein by reference.

BACKGROUND OF THE INVENTION

1. Field of the Invention

The present invention relates to a fully automatic, mechanical decompressor for internal combustion engines. In particular, the present invention relates to a decompressor that is used to make the engine starting procedure easier. Specifically, the decompressor in accordance with the principles of the present invention discharges some compressed gas from the cylinder during the compression phase of the starting procedure.

2. Description of Related Art

In order to simplify the starting procedure or starting operation for an internal combustion engine without the help of auxiliary means such as electric starters or the like, it is customary to use decompressors during the starting procedure. Decompressors reduce the compression in the cylinder during the starting procedure, so that the amount of force required to start the engine is reduced a significant degree. Valve lifters are usually used to accomplish this in four-cycle engines. By contrast, two-cycle engines use decompressors because there are neither inlet nor exhaust valves in two-cycle engines. These decompressors are in the form of a valve that is used specifically for decompression and is raised or opened when the engine is being started. In this way, some of the gas that is in the combustion chamber can be discharged from the cylinder through this valve during the compression phase, so that only the gas that remains within the combustion chamber has to be compressed. Thus, the amount of force required for compression is reduced accordingly.

DE 1 949 541 A, DE 400 0864 A1, and U.S. Pat. No. 4,619,228 disclose locating a valve in the cylinder head or in the cylinder wall. The valve can be opened and closed by means of a pressure diaphragm. Usually, the pressure diaphragm consists of a spring-loaded diaphragm that is arranged in a housing, the diaphragm then opening the valve when the engine is not running, and closing it when the engine is running. To this end, the diaphragm is acted upon by excess-pressure or under-pressure, by way of pressure hoses. The necessary excess-pressures or under-pressures are tapped from the induction or exhaust system, or from the crank case of the internal combustion engine. The principle disadvantages inherent in such decompressors are that separate pressure lines must always be provided in order to actuate them and that, because of the relatively small pressure differential that acts on the diaphragm, they require a great deal of space. In addition, they allow gases that contain fuel to escape from the cylinder to the atmosphere, and this causes additional atmospheric pollution.

SUMMARY OF THE INVENTION

For this reason, it is the objective of the present invention is to correct these shortcomings and to create a decompressor of the type, which—given a small installed size—requires little or no maintenance, requires no external pressure lines, and decreases atmospheric pollution.

The present invention achieves these objectives by providing a decompressor having a valve body that is moved in the direction of its closed position by cylinder pressure, against the force of a spring. When the motor is not running, or when it is being started, the spring holds the valve body in its starting position and the gas can flow unhindered out of the combustion chamber and into the induction system or the crankcase, or escape to the atmosphere, for instance via the exhaust system of the engine. When the engine starts, the pressure in the combustion chamber increases, and the valve body is moved in the direction of the cylinder into its working position, against the force of the spring, with the result that gas can no longer escape from the cylinder by way of the decompressor. The decompressor in accordance with the present invention is characterized by better durability and less need for maintenance.

The valve body is supported in a valve housing so as to be displaceable within the housing and has along its axis of rotation a bore through which gas can flow from the combustion chamber into a chamber that is located behind the valve body. If sufficient pressure to overcome the force of the spring builds up in this chamber, the valve body is moved into its working position. To this end, a piston or a diaphragm can be arranged on the end of the valve body that is remote from the cylinder, and this seals the chamber against the valve housing and acts on the valve body with the closing force.

In its starting position, the valve body leaves one or a plurality of openings in the valve housing unobstructed, and gas can escape from the combustion chamber through these openings. When the valve body is in its working position, these openings are closed, so that gas is dependably prevented from escaping when the engine is running.

Since the valve body and the valve housing form one structural unit that simply has to be inserted into the cylinder wall or into the cylinder head and then secured, this results in a particularly low-maintenance decompression system which, should it become unserviceable, can be replaced or repaired very easily and rapidly. The decompressor according to the present invention is fully automatic, i.e., it functions without any manual intervention on the part of the operator. In addition to this, it requires no external control lines such as under-pressure or excess-pressure lines, and this reduces overall system costs and improves the reliability of the system.

The present invention is directed to a decompressor for use in an internal combustion engine. The invention is particularly advantageous for use in a two cycle internal combustion engine, but can be used for a four cycle internal combustion engine as well. The internal combustion engine includes a cylinder having a combustion chamber, an induction passageway supplying air to the combustion chamber, and a venting passageway extending from the combustion chamber to the induction passageway. According to a preferred embodiment of the present invention the decompressor is at least partially located within the venting passageway. The decompressor selectively opens and closes the venting passageway in response to an increase in pressure in the combustion chamber. The decompressor preferably includes an expansible cavity operably connected to the combustion chamber. The expansible cavity has an expanded position and a contracted position. The decompressor selectively opens the venting passageway to vent combustion gas from the combustion chamber to the induction passageway when the expansible cavity is in the contracted position. The decompressor closes the venting passageway when the expansible cavity is in the expanded position.

The decompressor mechanism further includes a valve housing partially located in the venting passageway and a valve body slidably received within the valve housing. The valve body has a first position corresponding to the contracted position such that the venting passageway is open such that compression gases are vented from the combustion chamber and a second position corresponding to the expanded position such that the venting passageway is closed such that compression gases are prevented from being vented from the combustion chamber through the venting passageway. The expansible cavity is at least partially formed by the valve housing and the valve body. The valve body moves from the first position to the second position in response to expansion of the expansible cavity from the contracted position to the expanded position.

The valve body preferably includes a central passageway formed therein. The central passageway is operatively connected to the expansible cavity. The central passageway operatively connects the expansible cavity to the combustion chamber. The decompressor further includes a pressure sensitive closure located within the expansible cavity to provide a releasable closure between the expansible cavity and the central passageway. The pressure sensitive closure is preferably a check valve.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS OF THE INVENTION

Figure 1:
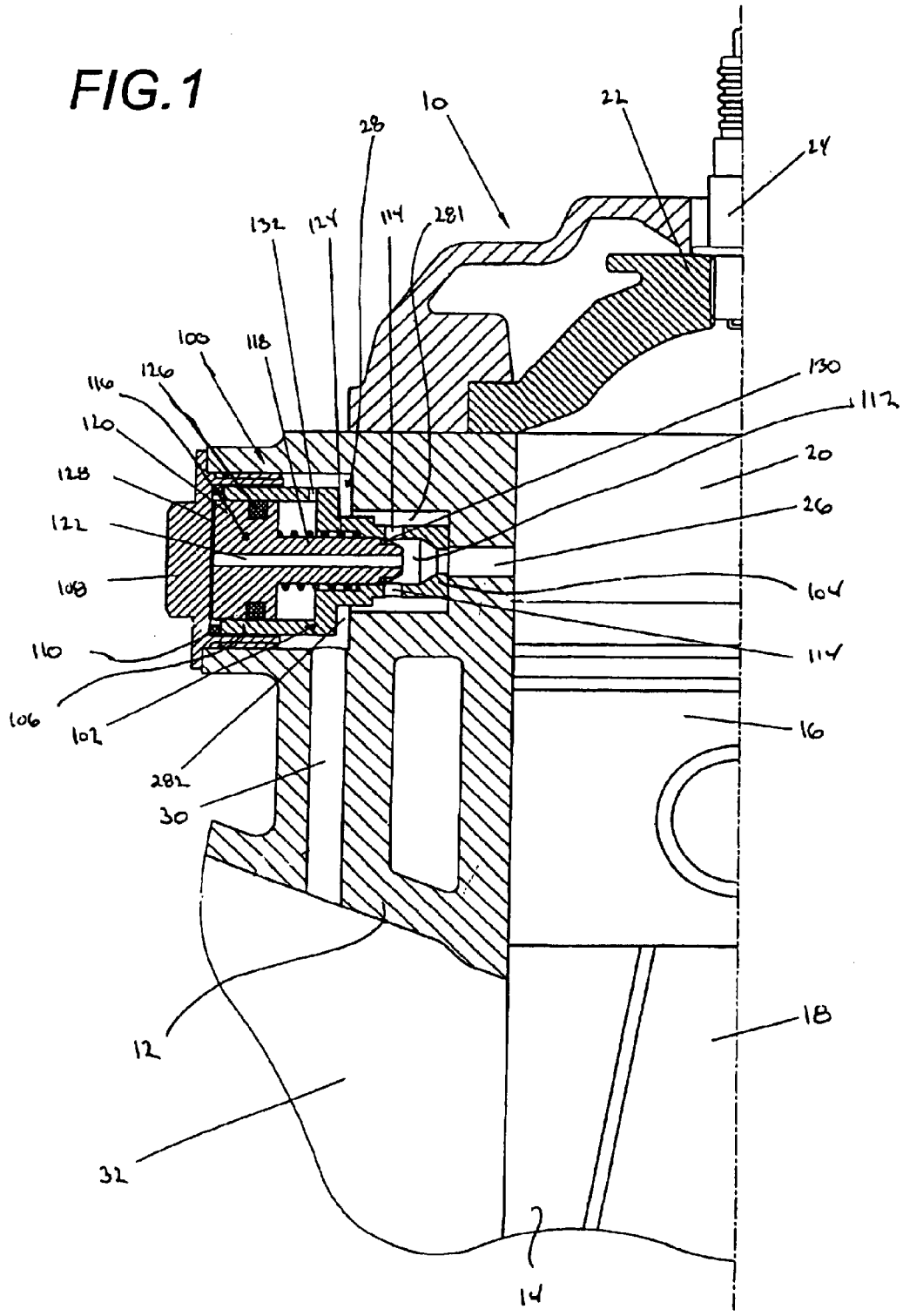
FIG. 1 is a cross sectional side view of a decompressor located within an internal combustion engine in accordance with the present invention, wherein the decompressor is illustrated in an engine start-up position.
Figure 2:
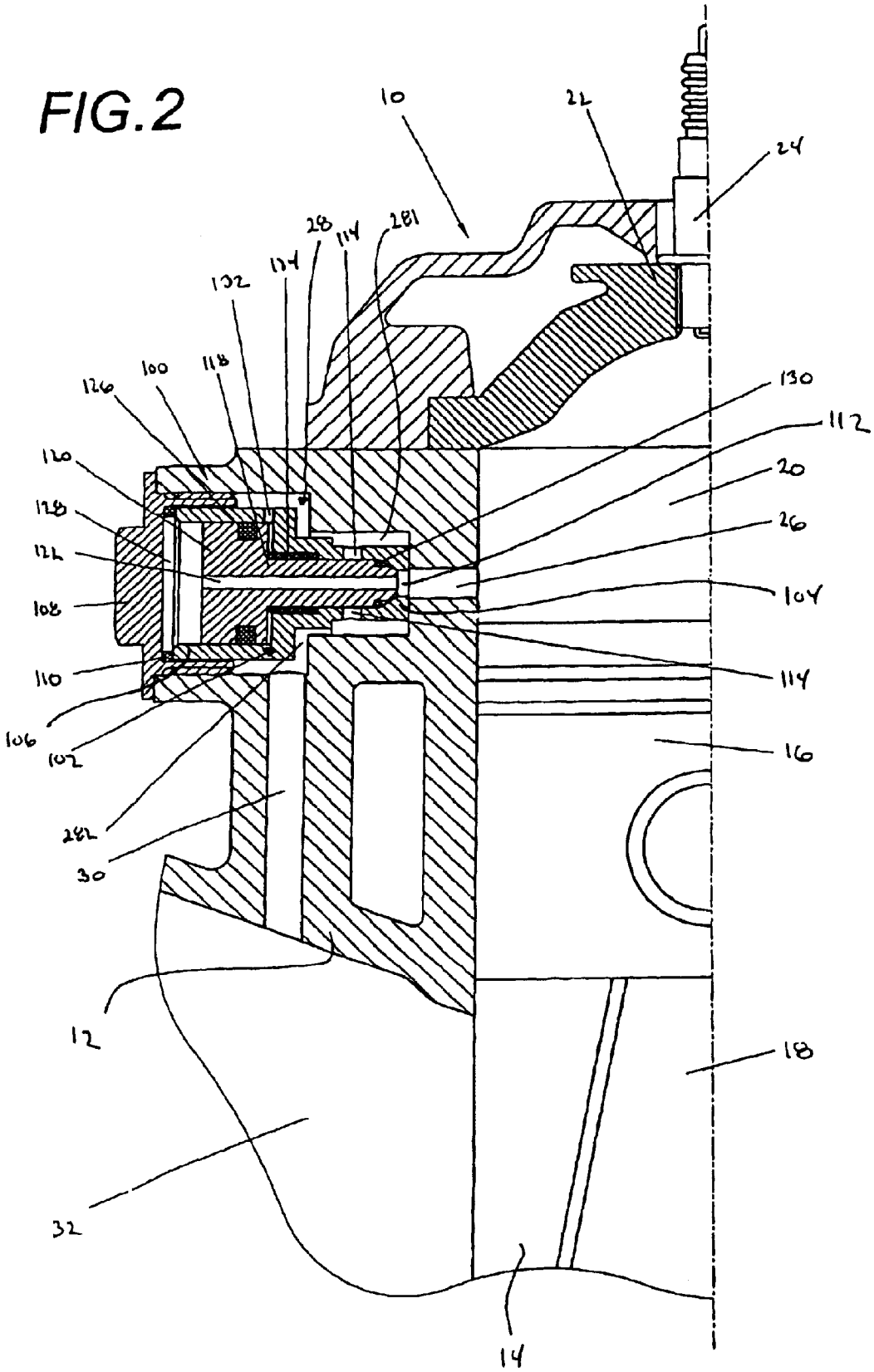
FIG. 2 is a cross sectional side view of the decompressor of FIG. 1, wherein the decompressor is illustrated in an engine running position.
Figure 3:
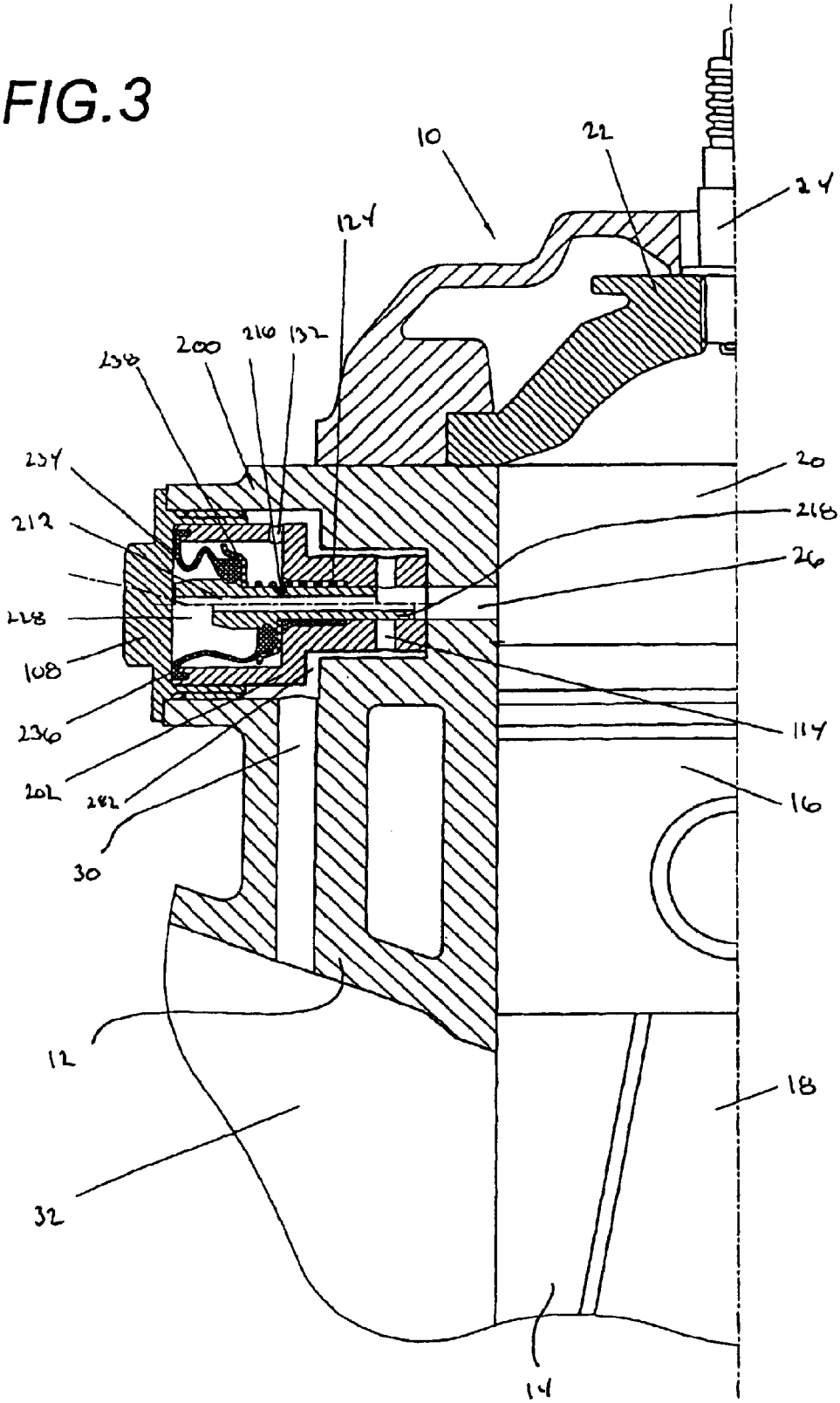
FIG. 3 is cross sectional side view of a decompressor in accordance with a variation of the decompressor of FIG. 1, wherein a portion of the decompressor is illustrated in the engine start-up position and a portion of the decompressor is illustrated in an engine.

The decompressors in accordance with embodiments of the present invention will be described in connection with a two cycle internal combustion engine 10. The present invention, however, is not limited to use in a two cycle engine. The invention may be used in a four cycle engine. The engine 10 includes a cylinder housing 12 having at least one cylinder 14 formed therein. It should be noted that each cylinder 14 has a similar construction. A piston 16 is slidably received within each cylinder 14. Each piston 16 is operatively connected to a crankshaft (not shown) through a connecting rod 18, shown in FIGS. 1–3. An upper portion of the cylinder 14 forms a compression chamber 20. A cylinder head 22 is secured to the cylinder housing 12 to seal each cylinder 14 and more particularly each compression chamber 20. A spark plug 24 can extend through the cylinder head 22 into the compression chamber 20. The cylinder housing 12 includes a first passageway 26, which extends from the compression chamber 20 to a decompressor receiving chamber or bore 28. The chamber 28 is sized to receive a decompressor described in detail below. The chamber or bore 28 has an inner portion 281 having a reduced diameter and an outer portion 282 having an enlarged diameter when compared to the inner portion 281. The first passageway 26 is operatively connected to the inner portion 281. A second passageway 30 extends from the chamber 28 to an induction passageway 32. The second passageway 30 is operatively connected to the outer portion 282. However according to another embodiment of the invention the second passageway 30 could be operatively connected to the inner portion 281. As shown in FIGS. 1–3, the induction passageway 32 is operatively connected to the cylinder 14. The induction passageway 32 may be formed in the cylinder housing 12 or operably coupled to the cylinder housing 12 or crankcase.

A decompressor 100 in accordance with a first embodiment of the present invention will now be described in connection with FIGS. 1 and 2. The decompressor 100 includes a valve housing 102 received within the chamber or bore 28 in the cylinder housing 12. The valve housing 102 has a reduced diameter inner portion 104 that is located within the inner portion 281 of the bore 28. The valve housing 102 further includes an outer portion 106 having an enlarged diameter when compared to the inner portion 104. The outer portion 106 is received within the outer portion 282 of the bore 28. When installed, the end of the valve housing 102 is located against an end portion of the bore 28, as shown in FIGS. 1 and 2. A cap 108 is provided to secure the valve housing 102 within the bore 28. The cap 108 can be threadably received within the bore 28. A snap fit connection is also contemplated provided a sufficient gripping force is present to prevent the removal of the cap 108 during operation of the engine 10. An o-ring, packing ring or other suitable seal 110 is provided between the cap 108 and the valve housing 102 to ensure a tight seal between the two components for reasons that will become apparent below and to prevent axial shifting of the valve housing 102 within the bore 28.

The valve housing 102 includes a passageway 112 formed therein. One end of the passageway 112 is operatively connected to the first passageway 26. At least one, in particular a plurality of openings 114, is provided which extend through the inner portion 104 of the valve housing 102. The openings 114 are positioned such that a passageway is opened between the passageway 112 and the inner portion 281 of the bore 28 at predetermined operating conditions (e.g., FIG. 1). As such a flow passageway is opened between the compression chamber 20 and the induction passageway 32 via the first passageway 26, the passageway 112, the passageways 114, the inner portion 281 and outer portion 282 of the bore 28, and the second passageway 30.

A valve body 116 is slidably received within the valve housing 102. The valve body 116 includes a stem portion 118 slidably located within the passageway 112 in the inner portion 104 of the valve housing 102. The valve body 116 further includes an enlarged head portion 120 connected to the stem portion 118. The head portion 120 is slidably received within the enlarged portion of the passageway 112 in the outer portion 106 of the valve housing 102. The valve body 116 includes a central passageway 122 extending therethrough. A spring 124 is provided to bias the valve body 116 in a direction away from the passageway 26. The valve body 116 is capable of sliding within the valve housing 102 against the force of the spring 124. A seal 126 is located within a recess in the head portion 120 of the valve body 116. The seal 126 provides a seal between the valve body 116 and the valve housing 102. The valve body 116, the valve housing 102 and the cap 108 form an expansible cavity 128. The expansible cavity 128 is shown in an enlarged state in FIG. 2. The cavity 128 is shown in a retracted state in FIG. 1. The seal 126 seals the cavity or chamber 128 from the outside.

The stem portion 118 of the valve body 116 includes a seal 130. The seal 130 provides a reliable seal between the valve body 116 and the valve housing 102 adjacent the first passageway 26 so that during normal engine operation, no or at least only a very limited amount of combustion gas within the chamber 20 can escape through the first passageway 26 into the second passageway 30.

The valve housing 102 is provided with at least one relief bore 132 formed therein. The relief bore is located in communication with bore 28 within the cylinder housing 12. The bore 132 permits air or other gases to escape in the area between the valve housing 102 and the valve body 116. With such an arrangement, the valve body 116 can be moved to a closed position due to a build up of pressure within expansible chamber 128 during normal engine operation.

The decompressor 100 is preferably arranged on the induction side of the cylinder 20, as shown in FIGS. 1 and 2. With such an arrangement, the connecting path (i.e., p second passageway 30) to the induction passage 32 can be incorporated very simply in the cylinder housing 12. Since most modem two-cycle engines have a valve for variable exhaust control on the exhaust side of the cylinder, there is insufficient space for a decompressor on the exhaust side of the cylinder. It is preferable that the decompressor 100 be arranged so that it is located as far up as possible in the cylinder 20 (i.e., close to the cylinder head 22, as shown in FIGS. 1 and 2). In such a location, particularly low starting forces can be achieved.

The operation of the decompressor 100 will now be described in greater detail. When the engine 10 is not running or during the starting phase, the valve body 116 is held in a starting position under the force of the spring 124, as shown in FIG. 1. During the starting phase, gases can pass from the combustion chamber 20 through the first passageway 26 in the cylinder housing 12 and into the valve housing 102. The gases are routed through the passageways 114 into the inner portion 281 of the bore 28. The gases then pass to the outer portion 282. From the outer portion 282, the gases pass into the second passageway 30 and finally into the induction passage 32 of the engine 10. The gases travel through a labyrinth of passageways as the gases pass from the chamber 20 and are finally vented to the induction passage 32. This causes the gases to sufficiently cool such that the gases are reliably prevented from igniting in the induction passage 32. The compression gases that are routed into the induction passage 32 are once again routed to the cylinder 20. The combustion gases/hydrocarbons that are contained therein are largely burned in the subsequent working cycle, and rendered largely innocuous thereby. This arrangement differs from known decompressors, disclosed above, which usually route the gases into the exhaust system or directly to the atmosphere. As such, the arrangement of the present invention prevents the pollutants (hydrocarbons) contained in the gases from escaping into the environment.

As soon as the engine 10 starts, there is an increase in combustion pressure as a result of the combustion gases in the cylinder 20. This increase in pressure will cause some combustion gases within the cylinder 20 to flow through the first passageway 26. The gases also flow into the central passageway 122. This causes the gases to flow into expansible cavity 128, which expands in response to the pressure buildup against the force of the spring 124 (i.e., the valve body 116 moves from the position shown in FIG. 1 to the position shown in FIG. 2). Any trapped air between the valve body 116 and the valve housing 102 is permitted to escape through the relief bore 132. This improves the operation of the decompressor 100. A buildup of pressure between the valve housing 102 and the valve body 116 would adversely act against closing direction of the valve and would make it more difficult for the decompressor. This venting permits the build up of pressure in the expansible cavity 128 to overcome the spring force of the spring 124 to move the valve body 112 to the position shown in FIG. 2.

Since the pressure that is effective as a closing force acts on the expansible chamber 128 only during each combustion process, it is advantageous to damp the return movement of the valve body 116 into its starting position such that the valve body 116 does not move pass the passageways 114 to permit the release of gas during a working stroke. This damping can be affected either by way of the seal 126, by way of the bores 132 that act as a choke, by way of a non-return valve or the like that is installed in the central passageway 122, or the like. Furthmore, the spring mass that comprises the valve body 116, and the spring 124 can be so designed that the decompressor 100 remains securely closed during a working stroke.

A variation of the decompressor 100 is illustrated in FIG. 3. The decompressor 200 shares numerous components with the decompressor 100. Like components are designated by like reference numerals. For the sake of brevity, further discussion of these common components will be omitted. The decompressor 200 includes a valve body 216 having a stem portion 218 that is slidably received within the passageway 212 within the valve housing 202. The valve housing 202 has substantially the same construction as the housing 102. The passageway 212 and the stem portion 218, however, do not have the tapered contrusction of passageway 112 and stem portion 118, as shown in FIGS. 1 and 2. Although not illustrated, the stem portion 218 may include a seal 130 secured to an end portion thereof.

The valve body 216 includes a diaphragm 234 secured thereto. An inner portion of the diaphragm 234 is secured to the valve body 216. An outer portion 236 of the diaphragm 234 is sealingly secured to the valve housing 202, whereby the outer portion 236 is compressed between the cap 108 and the housing 202. The diaphragm 234, the cap 108 and the housing 202 form an expansible cavity 228. The diaphragm 234 is supported on the valve body 216 by a diaphragm back-up plate 238.

The decompressor 200 operates much like the decompressor 100. The start-up position is illustrated in the lower portion of FIG. 3. The operating position is illustrated in the upper portion of FIG. 3. As soon as the engine 10 starts, there is an increase in combustion pressure. This increase in pressure will cause some combustion gases within the cylinder 20 to flow through the first passageway 26 into the central passageway 122. This causes the gases to flow into expansible cavity 228, which causes the expansible cavity 228 to expand in response to the pressure build up. The relief bores 132 operate in the same manner.

Figure 4:
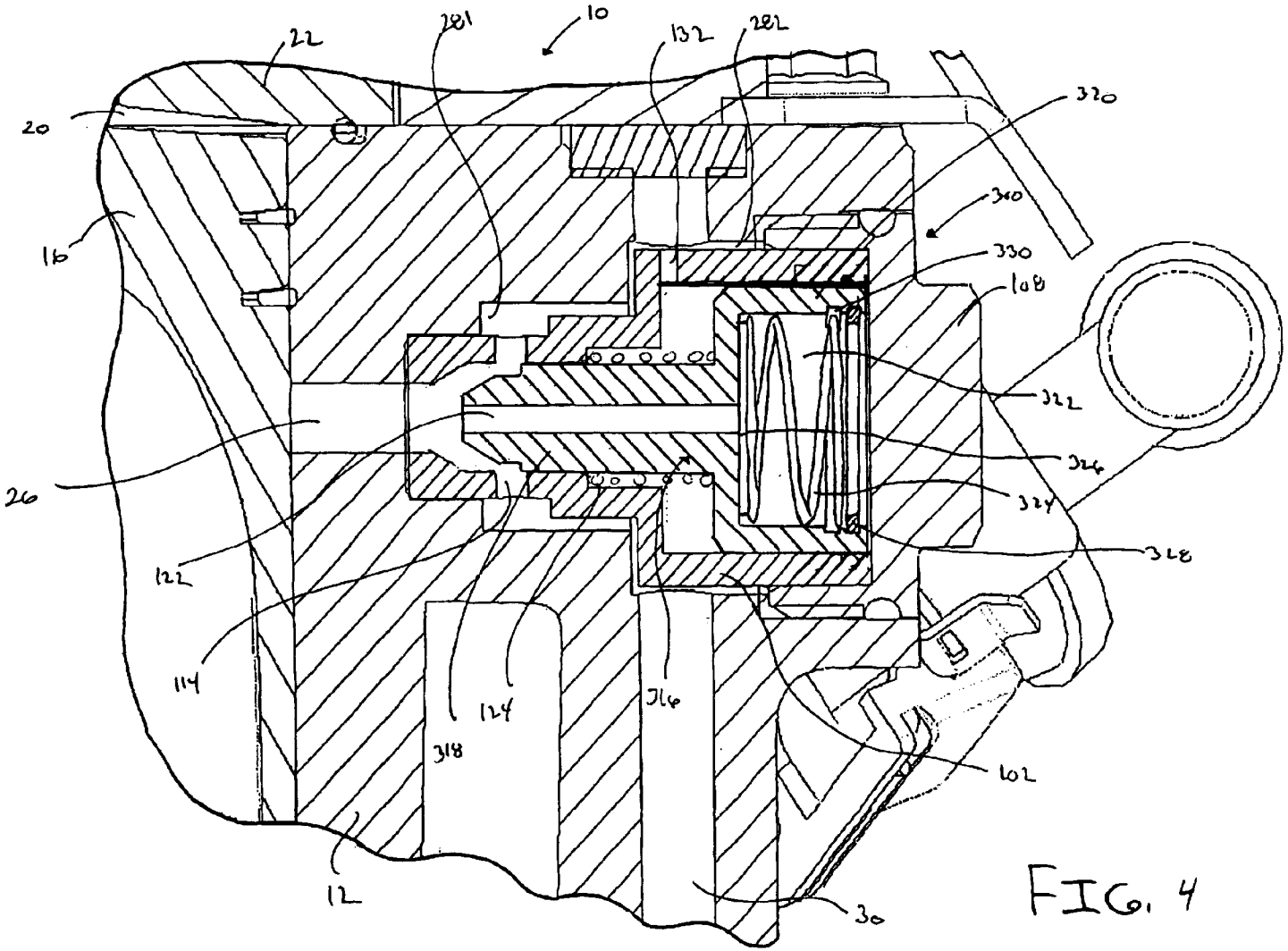
FIG. 4 is a cross section side view of a decompressor in accordance with another embodiment of the present invention, wherein the decompressor is illustrated in an engine startup position.
Figure 5:
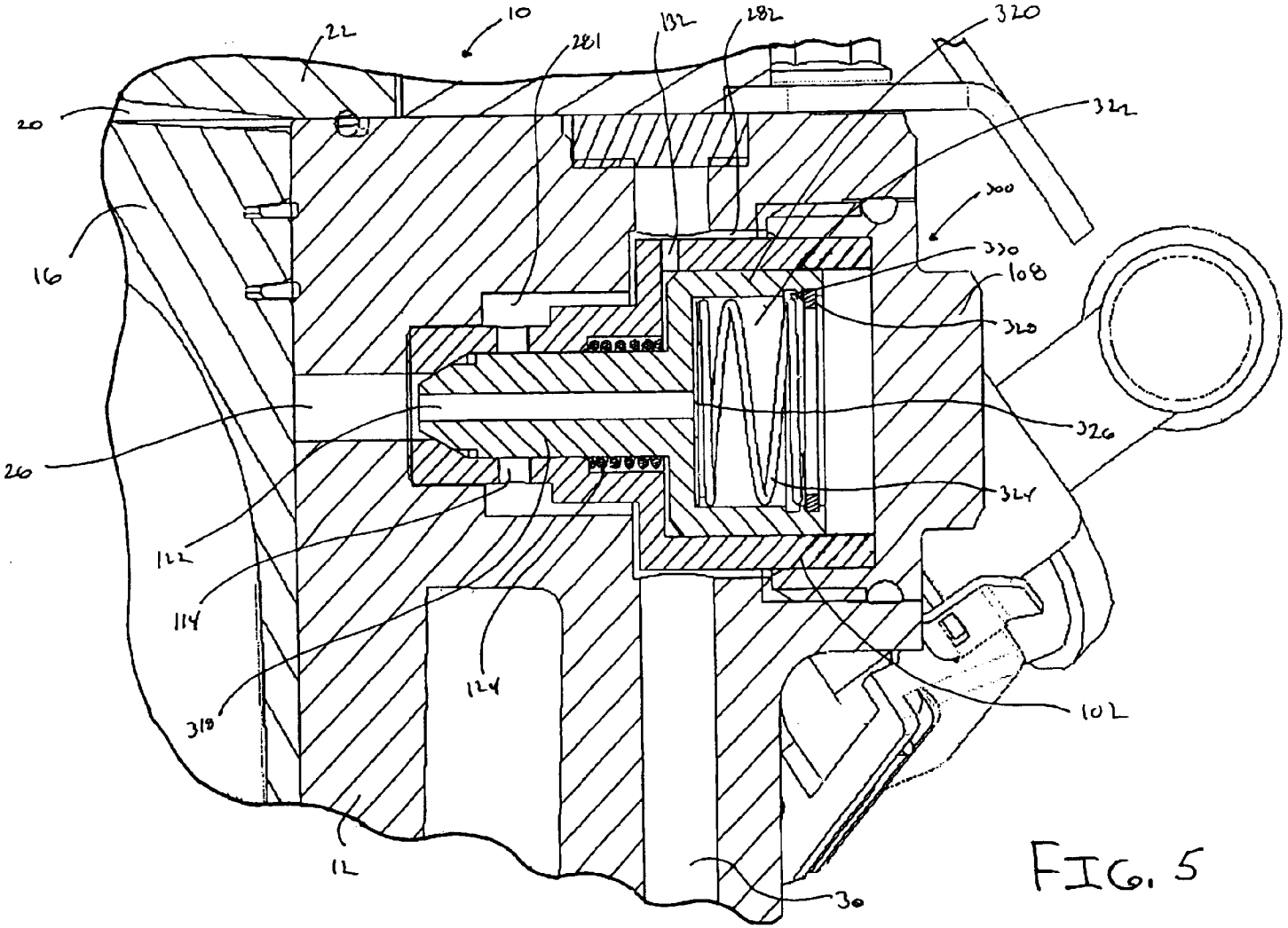
FIG. 5 is a cross sectional side view of the decompressor of FIG. 4, wherein the decompressor is illustrated in an engine running position.

A decompressor 300 in accordance with another embodiment of the present invention is illustrated in FIGS. 4 and 5. Like the decompressor 200, the decompressor 300 shares numerous components with the decompressor 100. The decompressor 300 includes a valve body 316 having a stem portion 318 and an enlarged head portion 320. The head portion 320 includes a cavity 322 formed therein. Located within the cavity 322 is a pressure sensitive closure for selectively opening and closing the communication between the cavity 322 and the passageway 122. The closure is preferably a check valve or a flutter valve. The valve can respond to any change in the pressure difference between the pressure in the expansible cavity 322 and the pressure in the passageway 122. This is an important characteristic because the cavity 322 looses pressure during operation (e.g., pressure may be lost along the surface between the valve body 316 and the valve housing 202). When the pressure within the cavity 322 decreases below a certain level, the flutter valve or check valve will permit communication between the cavity 322 and the passageway 122 such that the pressure within the cavity 322 is allowed to increase to cut off the venting passageway. The check or flutter valve may include a spring 324 and a closure plate 326. The spring 324 is partially received within a groove 330 in the head portion 320. A ring 328 prevents removal of the spring 324. The components of the check valve or flutter valve may be formed from a high temperature resistant material (e.g., a high temperature resistant plastic or heat resistant steel). Other pressure sensitive closures are considered to be well within the scope of the present invention.

During the start-up operation, the spring 124 biases the valve body 316 to the position shown in FIG. 4. In this position, the flow path is open between the first passageway 26 and the second passageway 30 so that combustion gases are vented to the induction passage 32. When the engine 10 starts, there is an increase in combustion pressure. This increase in pressure will cause the combustion gases to flow into passageway 122. In response to the predetermined build up of gases, the closure plate 326 is moved away from the passageway 122 against the bias of spring 324, which causes the cavity 322 to fill with gas. This causes the valve body 316 to move from the position shown in FIG. 4 to the position shown in FIG. 5. The pressure necessary to move the valve body 316 can be predetermined or set by selecting the spring forces of the springs 124 and 324. Additionally, the pressure is influenced by the respective diameters/dimensions of the passageways 26, 114, 281 and 30 used to vent the combustion/compression product from the compression chamber 20. The pressure is especially influenced by the effective diameter of the passageway 122 connecting the compression chamber 20 with the expansible cavity 128, 228 or 322.

The foregoing illustrated embodiments are provided to illustrate the structural and functional principles of the present invention and are not intended to be limiting. It goes without saying that the individual dimensions of the bores, openings, and channels, and the diameter of the piston will be matched to particular parameters such as the swept volume of the cylinder. Furthermore, the decompressor 100, 200 or 300 can be located in the cylinder housing 12 or the cylinder head 22. While not preferred, it is contemplated that the combustion gases can be vented to the atmosphere rather than to the induction passage 32. To the contrary, the principles of the present invention are intended to encompass any and all changes, alterations and/or substitutions within the spirit and scope of the following claims.

What is claimed is:

1. An internal combustion engine, comprising:

a cylinder having a combustion chamber and a cylinder housing;

the cylinder housing having a cavity, an induction passageway supplying at least one combustion component to the combustion chamber;

an exhaust passageway exhausting at least one combustion product from the combustion chamber, a venting passageway extending from the combustion chamber for venting the at least one combustion component from the combustion chamber; and a decompressor at least partially located within the venting passageway, the decompressor selectively opening and closing the venting passageway in response to a pressure in the combustion chamber;

the decompressor being received within the cavity of the cylinder housing; and the decompressor including an expansible cavity operatively connected to the combustion chamber, the expansible cavity having an expanded position and a contracted position, the decompressor closing the venting passageway when the expansible cavity is in the expanded position, the decompressor opening the venting passageway when the expansible cavity is in the contracted position;

the decompressor further comprising a valve housing; and a valve body moveably received within the valve housing, wherein the valve body has a first position corresponding to the contracted position of the expansible cavity such that the venting passageway is open and a second position corresponding to the expanded position of the expansible cavity such that the venting passageway is closed and wherein the valve body is slidably received within the valve housing; and the decompressor being releasably secured within the cavity of the cylinder housing by a cap.

2. The internal combustion engine of claim 1, wherein the expansible cavity is in fluid communication with the combustion chamber.

3. The internal combustion engine of claim 1, wherein the valve body includes a passageway formed therein, the valve body passageway being in fluid communication with the expansible cavity.

4. The internal combustion engine of claim 3, wherein the valve body passageway is also in fluid communication with the combustion chamber.

5. The internal combustion engine of claim 3, further comprising a pressure sensitive closure providing a releasable closure between the expansible cavity and the valve body passageway.

6. The internal combustion engine of claim 5, wherein the pressure sensitive closure is moveable between an open position and a closed position, and is biased in one of the open and the closed positions, and changes position in response to a pressure in the combustion chamber.

7. The internal combustion engine of claim 5, wherein the pressure sensitive closure is biased by a spring in the closed position, the spring having a first end secured to the valve body and a second end secured the pressure sensitive closure.

8. The internal combustion engine of claim 1, wherein the cavity of the cylinder housing forms a portion of the venting passageway.

9. The internal combustion engine of claim 1, further comprising a spring biasing the valve body in the first position.

10. The internal combustion engine of claim 9, wherein the expansion of the expansible cavity causes the valve body to move from the first position to the second position against the bias of the spring.

11. The internal combustion engine of claim 1, further comprising a pressure sensitive closure providing a releasable closure between the expansible cavity and the venting.

12. The internal combustion engine of claim 1, wherein the induction passageway is in fluid communication with the combustion chamber.

13. The internal combustion engine of claim 1, wherein the venting passage is in fluid communication with the induction passageway.

14. The internal combustion engine of claim 1, wherein the induction passageway is at least partially formed in the cylinder housing.

15. An internal combustion engine, comprising:

a cylinder having a combustion chamber and a cylinder housing;

the cylinder housing having a cavity;

an induction passageway supplying at least one combustion component to the, combustion chamber;

an exhaust passageway exhausting at least one combustion product from the combustion chamber;

a venting passageway extending from the combustion chamber for venting the at least one combustion component from the combustion chamber; and a decompressor at least partially located within the venting passageway, the decompressor selectively opening and closing the venting passageway in response to a pressure in the combustion chamber;

the decompressor being received within the cavity of the cylinder housing; and the decompressor including an expansible cavity operatively connected to the combustion chamber, the expansible cavity having an expanded position and a contracted position, the decompressor closing the venting passageway when the expansible cavity is in the expanded position, the decompressor opening the venting passageway when the expansible cavity is in the contracted position;

the decompressor further comprising a valve housing; and a valve body moveably received within the valve housing, wherein the valve body has a first position corresponding to the contracted position of the expansible cavity such that the venting passageway is open and a second position corresponding to the expanded position of the expansible cavity such that the venting passageway is closed and wherein the valve body is slidably received within the valve housing; and the decompressor being releasably secured within the cavity of the cylinder housing by a cap;

the expansible cavity being at least partially formed by the valve housing, the valve body and the cap.

16. The internal combustion engine of claim 15, wherein the expansible cavity is in fluid communication with the combustion chamber.

17. The internal combustion engine of claim 15, wherein the valve body includes a passageway formed therein, the valve body passageway being in fluid communication with the expansible cavity.

18. The internal combustion engine of claim 17, wherein the valve body passageway is also in fluid communication with the combustion chamber.

19. The internal combustion engine of claim 17, further comprising a pressure sensitive closure providing a releasable closure between the expansible cavity and the valve body passageway.

20. The internal combustion engine of claim 19, wherein the pressure sensitive closure is moveable between an open position and a closed position, and is biased in one of the open and the closed positions, and changes position in response to a pressure in the combustion chamber.

21. The internal combustion engine of claim 19, wherein the pressure sensitive closure is biased by a spring in the closed position, the spring having a first end secured to the valve body and a second end secured the pressure sensitive closure.

22. The internal combustion engine of claim 15, wherein the cavity of the cylinder housing forms a portion of the venting passageway.

23. The internal combustion engine of claim 15, further comprising a spring biasing the valve body in the first position.

24. The internal combustion engine of claim 23, wherein the expansion of the expansible cavity causes the valve body to move from the first position to the second position against the bias of the spring.

25. The internal combustion engine of claim 15, further comprising a pressure sensitive closure providing a releasable closure between the expansible cavity and the venting passageway.

26. The internal combustion engine of claim 15, wherein the induction passageway is in fluid communication with the combustion chamber.

27. The internal combustion engine of claim 15, wherein the venting passage is in fluid communication with the induction passageway.

28. The internal combustion engine of claim 15, wherein the induction passageway is at least partially formed in the cylinder housing.

* * * * *